United States Patent [19]

Hannecke

[11] Patent Number: 4,512,262

[45] **Date of Patent: * Apr. 23, 1985**

[54] ARTICLE DISPLAY STAND

[76] Inventor: Wolf-Dietrich Hannecke, Rischenau Weg 6, 3410 Northeim, Fed. Rep. of Germany

[ * ] Notice: The portion of the term of this patent subsequent to Jun. 29, 1999 has been disclaimed.

[21] Appl. No.: 330,771

[22] Filed: Dec. 14, 1981

Related U.S. Application Data

[63] Continuation-in-part of Ser. No. 821,410, Aug. 3, 1977.

[30] Foreign Application Priority Data

Mar. 3, 1977 [DE] Fed. Rep. of Germany ... 7706489[U]
Mar. 3, 1977 [DE] Fed. Rep. of Germany ... 7706490[U]
Mar. 4, 1977 [DE] Fed. Rep. of Germany ... 7706706[U]

[51] Int. Cl.[3] ..... A47B 57/00

[52] U.S. Cl. ..... 108/61; 108/144; 108/151

[58] Field of Search ..... 108/144, 151, 60, 61, 108/149; 211/128, 131, 184; D6/191

[56] References Cited

U.S. PATENT DOCUMENTS

| | | | |
|---|---|---|---|
| D. 266,210 | 9/1982 | Hannecke | D6/191 |
| 2,915,194 | 12/1959 | Shoffner | 108/144 |
| 3,035,706 | 5/1962 | Burke | 211/131 |
| 3,176,676 | 4/1965 | Caldwell | 108/144 X |
| 3,361,508 | 1/1968 | Chassevent | 108/60 |
| 3,501,019 | 3/1970 | Armstrong | 108/61 |
| 3,604,369 | 9/1971 | Maslow | 108/144 |
| 3,683,824 | 8/1972 | Weber | 108/151 |
| 3,964,404 | 6/1976 | Mueller | 108/144 |
| 4,014,437 | 3/1977 | Rumble et al. | 211/131 |
| 4,336,759 | 6/1982 | Hannecke | 108/144 |

*Primary Examiner*—Francis K. Zugel
*Attorney, Agent, or Firm*—Michael J. Striker

[57] ABSTRACT

An article display stand, has an elongated upright support with a plurality of recesses, and an article supporting element having a projection engageable in each of the recesses and including a substantially horizontal base plate arranged to support articles and a substantially upright hollow conical member connected with the base plate and fittable onto the support.

18 Claims, 6 Drawing Figures

FIG. 4
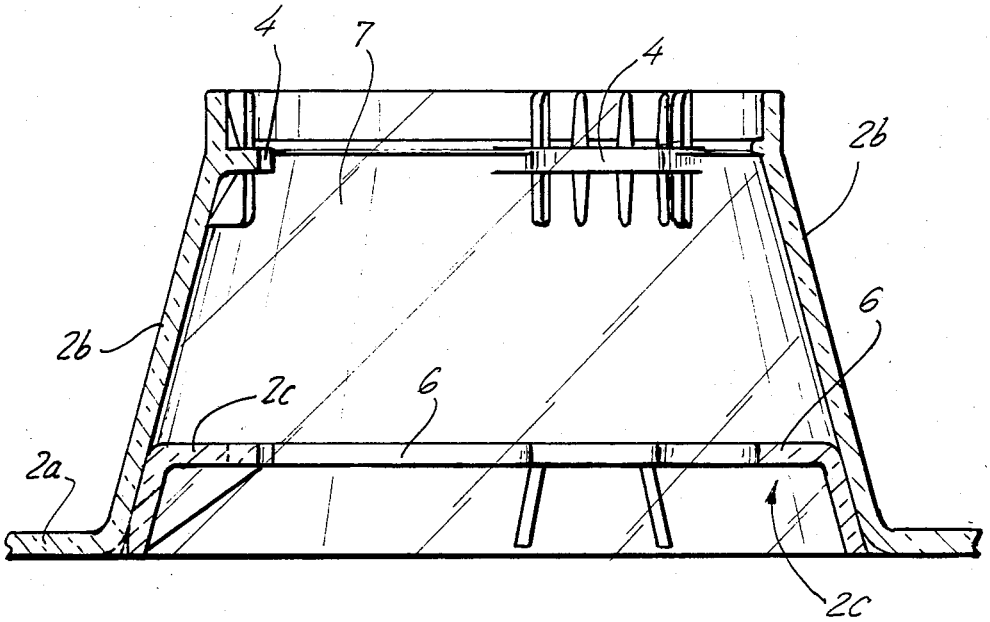
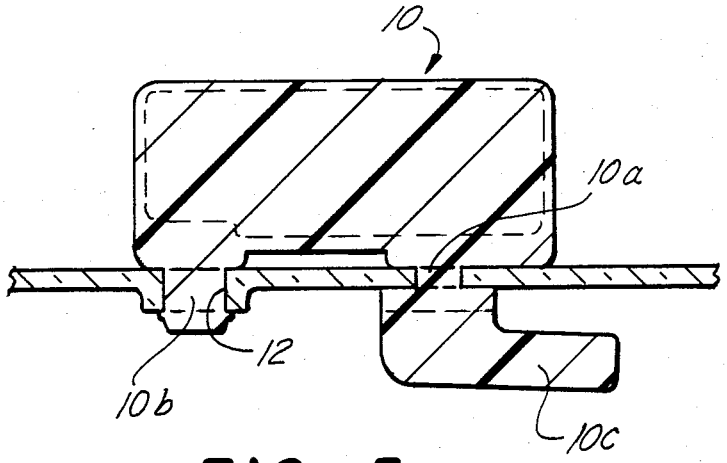
FIG. 5

ARTICLE DISPLAY STAND

CROSS-REFERENCE TO RELATED APPLICATION

This application is a continuation-in-part of application Ser. No. 821,410, filed on Aug. 3, 1977.

BACKGROUND OF THE INVENTION

The present invention relates to an article display stand, and particularly to an article display stand which has an upright support and an article supporting element mounted on the support.

Article display stands of the abovementioned general type are known in the art. One of the article display stands disclosed in the U.S. patent application Ser. No. 812,410 includes an upright support provided with a plurality of recesses which are spaced from one another and located adjacent to each other in the direction of elongation of the support, and an article supporting element mountable in the support in any of a plurality of positions spaced longitudinally of the support and having a projection which is detachably engageable with respective ones of the recesses, so that when the projection of the support element engages one of the recesses of the support, the article supporting element is fixed in a respective one of the positions. This article display stand can be used for the display of article of different dimensions and at the same time is of a simple construction, easy to manufacture and assemble, and inexpensive. However, it is not perfect in the sense of its stability and strength.

SUMMARY OF THE INVENTION

Accordingly, it is an object of the present invention to provide an article display stand which avoids the disadvantages of the prior art.

More particularly, it is an object of the present invention to provide an article display stand which is more stable and rigid than the known article display stands.

In keeping with these objects, and with others which will become apparent hereinafter, one feature of the present invention resides, briefly stated, in an article display stand, which has an elongated upright support with a plurality of recesses, and an article supporting element provided with a projection engagable in each of these recesses, wherein the article supporting element includes a substantially horizontal base plate arranged to support articles and a substantially upright hollow conical member connected with the base plate and fitted onto the support.

When the article supporting element is provided with the abovementioned conical member the article display stands becomes more rigid and stable.

In accordance with another, especially advantageous feature of the present invention, upright walls which form a plurality of compartments on an upper surface of the base plate are connected by their radially inner ends with the conical member. This further contributes to the stability and rigidity of the display stand.

Still another feature of the present invention resides in the fact that two projections are provided on the article supporting element, of which one projection is located in the upper region of the conical member and the other projection is located in the lower region of the conical member so that both projections can engage in the recesses of the support at vertically spaced locations.

A further feature of the present invention is that a plurality of adjusting walls are provided in the abovementioned compartments and arranged movable so as to adjust the size of the compartments.

Finally, a plurality of closing walls are provided which are movable between two positions in which they close or open the compartments accommodating the articles to be displayed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 4 is a view showing a cross-section of a conical member of the article supporting element of the inventive display stand;

FIG. 5 is a view showing a section of an adjusting wall in compartments formed on the article supporting element.

DESCRIPTION OF A PREFERRED EMBODIMENT

Figure 1:
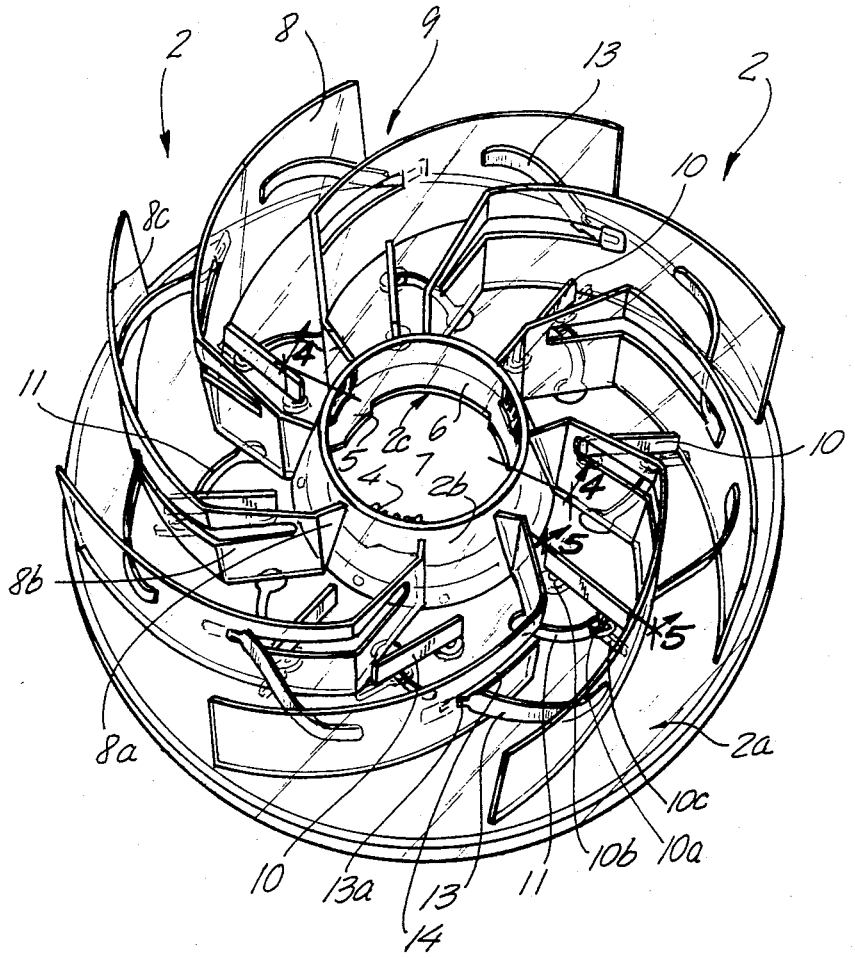
FIG. 1 is a perspective view showing an article supporting element of an article display stand in accordance with the present invention.

An article display stand in accordance with the present invention has an upright support identified in toto by reference numeral 1 and an article supporting element identified in toto by reference numeral 2.

Figure 2:
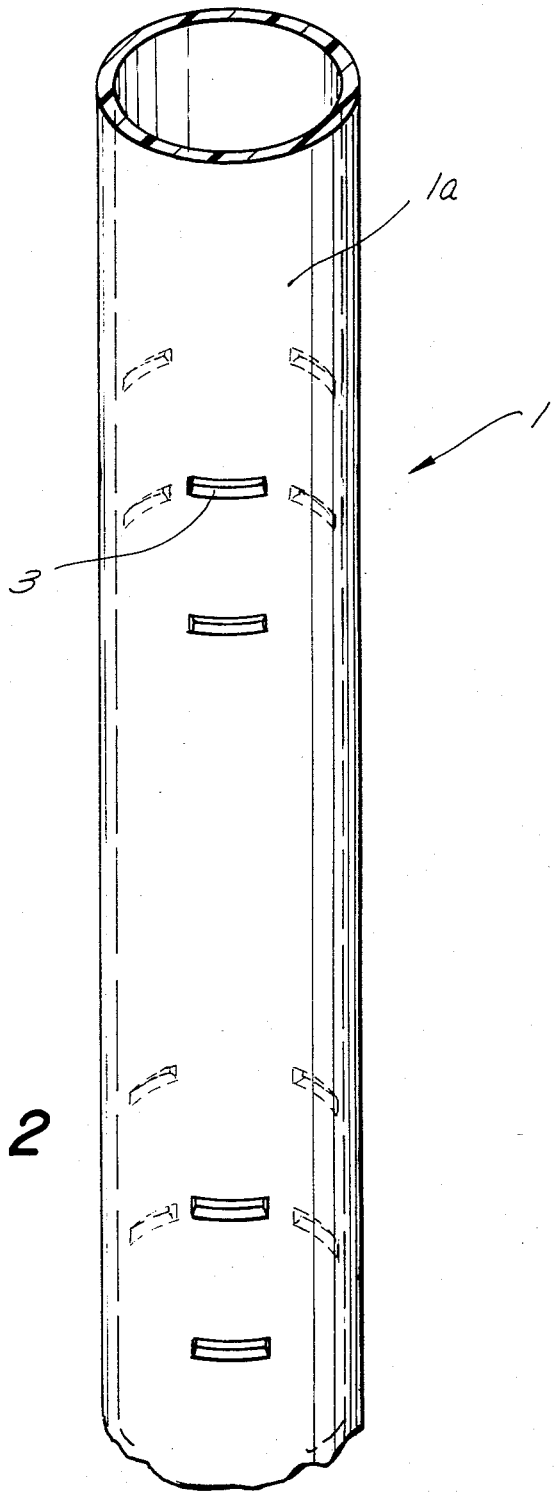
FIG. 2 is a view showing a support of the article display stand in accordance with the present invention.
Figure 6:
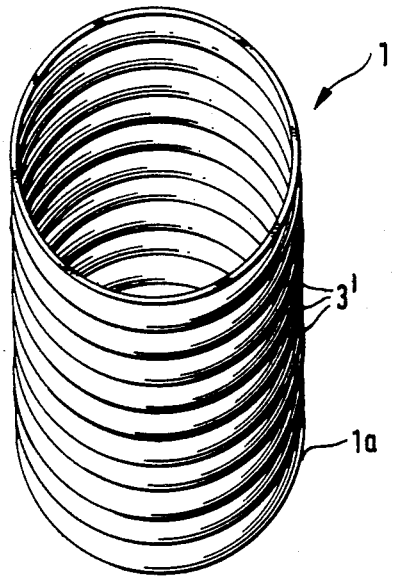
FIG. 6 is a view showing the support in accordance with another embodiment of the invention.

The support 1 is preferably formed as a tubular member l*a* and has a plurality of recesses 3. As shown in FIG. 2, the recesses are formed as slots which are arranged in several rows. The rows of the slots 3 are spaced from each other for an identical distance in the circumferential direction of the tubular member l*a*, whereas the slots 3 of each row are spaced from each other in a direction of elongation of the tubular member l*a*. The slots 3 of each row are located as close as possible relative to each other and, at the same time, with due regard for the fact that the rigidity of the tubular member l*a* must not be excessively reduced. The slots 3 are formed as through-going openings extending through the wall of the tubular member 1*a*. However, they may be formed as indentations provided on an outer surface of the tubular member 1*a*. The recesses shown in FIG. 2 are formed as discrete slots which are separated from one another by a material of the tubular member 1*a*. However, it is possible to form these recesses as a single continuous helical groove 3′ extending over the tubular member 1*a* as shown in FIG. 6.

The article supporting element 2 has a base plate 2*a* and a conical member 2*b* connected with the latter. The base plate 2*a* is formed of one piece with the conical member 2*b*. However, it is also possible to form them as separate members which are subsequently connected with one another by connecting means. An insert 2c is arranged inside the conical member 2b and connected with the latter, for example, by screws. It is of course also possible to make the insert 2c of one piece with the conical member 2b.

The article supporting element 2 has at least two projections 4 and 5 which are spaced from one another in a vertical direction. Only one such projection can be provided in the article supporting element, however, it is advantageous to provide two projections 4 and 5 at two vertically spaced locations. Several rows of the projections 4 and 5 may also be formed in the article supporting element as shown in FIG. 1. The upper projections are arranged on the conical member 2b, whereas the lower projections are formed on a collar 6 of the insert 2c. The projections 4 and 5 extend radially inwardly into an inner opening 7 of the article supporting element. The radial lengths of the projections 4 and 5 are such that the inner ends of the projections 4 and 5 bound circular openings of identical diameters. It is to be understood that the distance between the projections 4 and 5 corresponds to the distance between two recesses 3 of the support 1. When the article supporting element 2 is fitted onto the support 1, the projections 4 and 5 engage into the respective recesses 3. The tubular member 1a of the support 1 is composed of a resiliently yieldable material, such as a plastic material, and thereby can resiliently yield during fitting of the article supporting element 2 thereonto.

Figure 3:
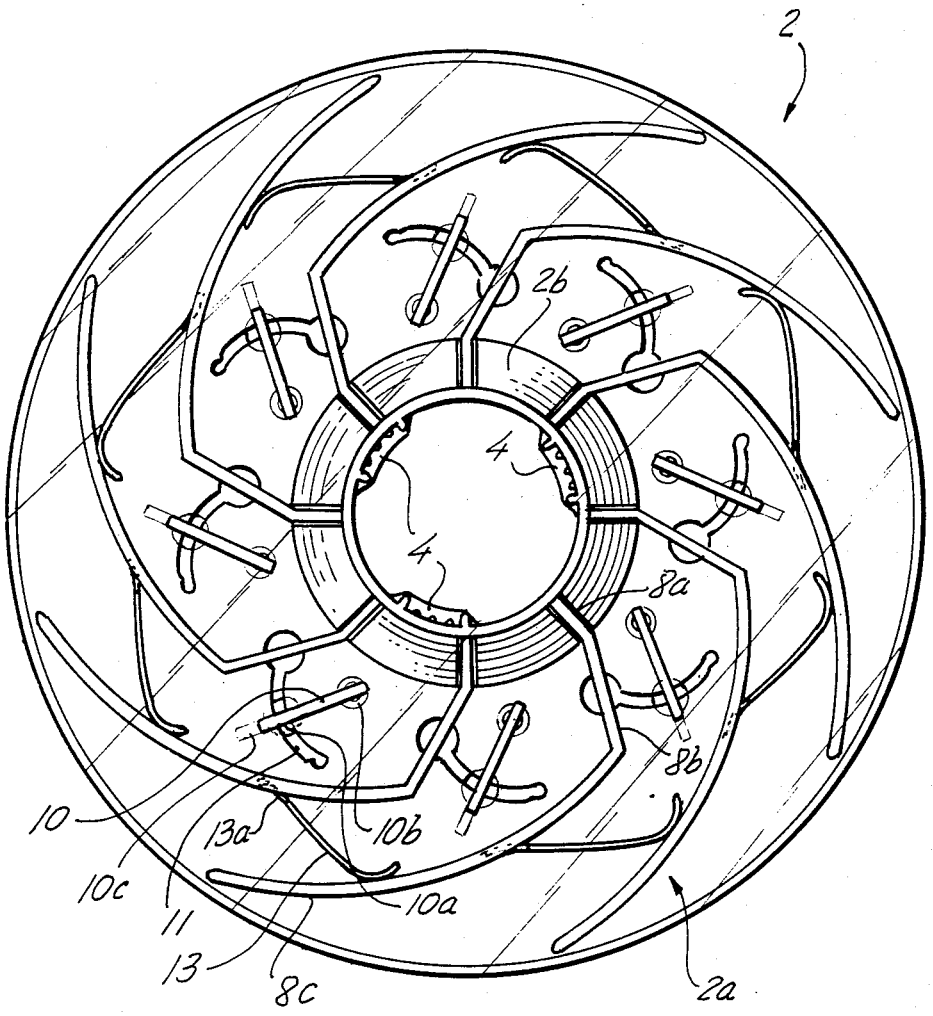
FIG. 3 is a plan view of the article supporting element shown in FIG. 1.

A plurality of walls 8 are arranged on the upper surface of the base plate 2a of the article supporting element 2. The walls 8 are connected to the base plate 2a by any suitable means and form a plurality of compartments 9 therebetween. The compartments 9 are arranged for accommodating articles to be displayed on the article display stand in accordance with the invention. The walls 8 extend from the radially inner region of the base plate 8 to the radially outer region of the same and at the same time do not coincide with the radii of the base plate to considerably deviate from the radii. As a result of this, the compartments 9 are shaped as spiral segments. The walls 8 have radially inner end portions which are connected with the tubular member 2b of the article supporting element 2. The connection can be carried out in any suitable manner, for example, by glueing, welding, engaging into grooves on the conical member and the like. As can be seen from FIG. 3, each wall has a radially inner portion 8a which is straight and extends in a radial direction, an intermediate portion 8b which is straight and extends at an angle to the respective radius, and a radially outer portion 8c which is substantially circular and extends both in radial and circumferential directions.

Each compartment 9 has an adjusting wall 10 and a slot 11 formed in the base plate 2a. The slots 11 extends in a direction which is substantially transverse to the elongation of the respective compartment 9. The adjusting wall 10 has a first end portion 10b which is pivotally mounted in an opening 12 of the base plate 2a, so that the end portion 10b can rotate in the opening 12. Each adjusting wall 10 also has a second end portion 10a which extends through the slot 11 so that the end portion 10a can move along the slot to assume each of a plurality of positions between two neighboring walls 8. As a result of this, the width of each compartment 9 can be varied. The end portion 10a of the adjusting wall 10 extends downwardly beyond the slot 11 and forms a handle 10c to facilitate the abovementioned movement of the end portion 10a along the slot 11.

The article supporting element 2 also has a plurality of closing walls 13 each provided in a respective one of the compartments 9. Each of the walls is movable between open and closed positions in which it respectively opengs or closes the respective compartment 9. Each wall 13 is connected with one of the two neighboring walls 8 and extends across the compartment 9 to the other of the two neighboring walls. The closing wall 13 is curved so that in the closed position its free end abuts against the other neighboring wall. The closing walls are connected with the walls 8 in any suitable manner, for example by glueing, welding and the like. At the same time, the closing walls 13 are resiliently yieldable. When an article is inserted into the respective compartment 9 by movement from the radially outer region of the compartment to the radially inner region, the closing wall 13 is resiliently forced inwardly under the action of the article so as to allow the movement of the latter inside the compartment. On the other hand, the shape and resiliency of the closing walls 13 are such that the article is safely and withdrawably supported in the compartment in upright position by pressing the article against the closing wall 13.

Each of the walls 8 has a slot 14 with a shape substantially corresponding to the shape of the closing wall 13. During the abovementioned movement of the article inwardly of the respective compartment 9, the closing wall 13 which deviates from its closed position under the action of the article can be withdrawn into the slot 14. As can be seen from the drawings, each closing wall 13 has a narrower end portion 13a connecting the former with the respective wall 8.

Various modifications of the above-described features are possible. The walls 9 or the entire article supporting element 2 (with the exception of the walls 10 and 13) may be composed of a translucent material or light impermeable material. The projections 4 and 5 are arranged, as shown in the drawing, at circumferentially identical locations. It is, however, possible to provide the projections 4 and 5 at locations which are offset from one another in the circumferential direction.

It will be understood that each of the elements described above, or two or more together, may also find a useful application in other types of constructions differing from the types described above.

While the invention has been illustrated and described as embodied in an article display stand, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. The article display stand comprising an elongated upright resiliently deformable support having a plurality of recesses which are spaced from and located adjacent to each other in the direction of elongation of said support; and an article supporting element mountable in said support in any of a plurality of positions spaced longitudinally of said support and having a projection which is detachably engageable with respective ones of said recesses so that, when said projection of said article supporting element engages in one of said recesses of said support, said article supporting element is fixed in a respective one of said positions, said article supporting element including a substantially horizontal base plate arranged to support articles and a substantially upright hollow conical member connected with said base plate and fittable onto said support, said conical member having an upper region and a lower region, said article supporting element having a second such projection upwardly spaced from said first-mentioned projection, said first-mentioned projection being arranged in said lower region of said conical member whereas said second projection is arranged in said upper region thereof.

2. The article display stand as defined in claim 1, wherein said conical member has a main conical part and an insert which is inserted in said main conical part in said lower region, said first-mentioned projection being arranged on said insert, whereas said second projection is arranged on said main conical part.

3. The article display stand comprising an elongated upright resiliently support having a plurality of recesses which are spaced from and located adjacent to each other in the direction of elongation of said support; and an article supporting element mountable in said support in any of a plurality of positions spaced longitudinally of said support and having a projection which is detachably engageable with respective ones of said recesses so that, when said projection of said article supporting element engages in one of said recesses of said support, said article supporting element is fixed in a respective one of said positions, said article supporting element including a substantially horizontal base plate arranged to support articles and a substantially upright hollow conical member connected with said base plate and fittable onto said support, said support having another such plurality of recesses spaced from said first-mentioned plurality in the circumferential direction of said support, said article supporting element having another such projection engaging with a respective ones of the recesses of said other plurality.

4. The article display stand comprising an elongated upright resiliently deformable support having a plurality of recesses which are spaced from and located adjacent to each other in the direction of elongation of said support; and an article supporting element mountable in said support in any of a plurality of positions spaced longitudinally of said support and having a projection which is detachably engageable with respective ones of said recesses so that, when said projection of said article supporting element engages in one of said recesses of said support, said article supporting element is fixed in a respective one of said positions, said article supporting element including a substantially horizontal base plate arranged to support articles and a substantially upright hollow conical member connected with said base plate and fittable onto said support, said base plate of said article supporting element having an upper surface and a plurality of walls extending upwardly from said upper surface and forming a plurality of compartments therebetween, each of said walls having a radially inner end portion connected with said conical member.

5. The article display stand as defined in claim 4, wherein said compartments are spaced from one another in the circumferential direction of said base plate.

6. The article display stand as defined in claim 4, wherein said walls are curved so that they deviate from radii of said base plate and thereby said compartments are formed as spiral segments.

7. The article display stand as defined in claim 4; and further comprising a plurality of adjusting walls each arranged in a respective one of said compartments between two neighboring first-mentioned walls and movable relative to the latter so as to adjust the size of said compartments.

8. The article display stand as defined in claim 7, wherein each of said compartments has a longitudinal dimension extending substantially from inside to outside of said base plate, and a transverse dimension extending transverse to said longitudinal dimension, said adjusting walls being movable so as to change said transverse dimensions of said compartments.

9. The article display stand as defined in claim 8, wherein each of said adjusting walls are pivotable and each has a first end portion pivotally connected with said base plate, and a second end portion spaced from said first end portion and movable in direction of said transverse dimension of each of said compartments.

10. The article display stand as defined in claim 9; and further comprising means for guiding said adjusting walls during their movement, said guiding means including a guiding groove formed in said base plate in the region of each of said compartments and arranged so that said second end portion of each of said adjusting walls movably engages in said guiding groove.

11. The article display stand as defined in claim 4; and further comprising means for closing each of said compartments and including a plurality of closing walls each arranged in a respective one of said compartments and movable between open and closed position in which it opens and closes the latter, respectively.

12. The article display stand as defined in claim 11, wherein each of said closing walls is resiliently yieldable so as to move between said open and closed positions by resiliently deflecting said closing walls.

13. The article display stand as defined in claim 12, wherein each of said closing walls has a first end portion connected with one of two neighboring ones of said first-mentioned walls, and second end portion arranged to abut against the other of the two neighboring first-mentioned walls in said closed position.

14. The article display stand as defined in claim 13, wherein said first end portion is narrower than a remaining portion of each of said closing walls.

15. The article display stand comprising an elongated upright resiliently deformable support having a plurality of recesses which are spaced from and located adjacent to each other in the direction of elongation of said support; and an article supporting element mountable in said support in any of a plurality of positions spaced longitudinally of said support and having a projection which is detachably engageable with respective ones of said recesses so that, when said projection of said article supporting element engages in one of said recesses of said support, said article supporting element is fixed in a respective one of said positions, said article supporting element including a substantially horizontal base plate arranged to support articles and a substantially upright hollow conical member connected with said base plate and fittable onto said support, said recesses together forming a continuous helical groove.

16. The article display stand comprising an elongated upright resiliently deformable support having a plurality of recesses which are spaced from and located adjacent to each other in the direction of elongation of said support; and an article supporting element mountable in said support in any of a plurality of positions spaced longitudinally of said support and having a projection which is detachably engageable with respective ones of said recesses so that, when said projection of said article supporting element engages in one of said recesses of said support, said article supporting element is fixed in a respective one of said positions, said article supporting element including a substantially horizontal base plate arranged to support articles and a substantially upright hollow conical member connected with said base plate and fittable onto said support, said support being resiliently deformable.

17. The article display stand comprising an elongated upright resiliently deformable support having a plurality of recesses which are spaced from and located adjacent to each other in the direction of elongation of said support; and an article supporting element mountable in said support in any of a plurality of positions spaced longitudinally of said support and having a base plate with an upper surface, a plurality of walls extending from said upper surface, and a projection which is detachably engageable with respective ones of said recesses so that, when said projection of said article supporting element engages in one of said recesses of said support, said article supporting element is fixed in a respective one of said positions, said article supporting element including a substantially horizontal base plate arranged to support articles and a substantially upright hollow conical member connected with said base plate and fittable onto said support, said walls being composed of a translucent material.

18. An article display stand, comprising an elongated upright support having a plurality of recesses which are spaced from and located adjacent to each other in the direction of elongation of said support; and an article supporting element mountable in said support in any of a plurality of positions spaced longitudinally of said support and having a projection which is detachably engageable with respective ones of said recesses so that, when said projection of said support element engages in one of said recesses of said support, said article supporting element is fixed in a respective one of said positions, said article supporting element including a substantially horizontal base plate arranged to support articles and a substantially upright hollow conical member connected with said base and fittable onto said support, said base plate of said article supporting element having an upper surface and a plurality of walls extending upwardly from said upper surface and forming a plurality of compartments therebetween, said article supporting element also having a plurality of closing walls each arranged in a respective one of said compartments and movable between open and closed position in which it opens and closes the latter, respectively, each of said first-mentioned walls having a receiving opening with a shape substantially corresponding to the shape of each of said closing walls, so that in said open position each of said closing walls can be at least received into a respective one of said receiving openings.

* * * * *